US006638094B1

(12) United States Patent
Zhang et al.

(10) Patent No.: US 6,638,094 B1
(45) Date of Patent: Oct. 28, 2003

(54) ZERO INSERTION FORCE SOCKET WITH ACTUATION PROTECTION DEVICE

(75) Inventors: Jian Zhang, Shenzhen (CN); Ming-Lun Szu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/286,080

(22) Filed: Nov. 1, 2002

(30) Foreign Application Priority Data

Jun. 13, 2002 (TW) ..... 91208820 U

(51) Int. Cl.[7] ..... H01R 13/625
(52) U.S. Cl. ..... 439/342
(58) Field of Search ..... 439/342, 259–270, 439/70–73

(56) References Cited

U.S. PATENT DOCUMENTS 6,383,007 B1 * 5/2002 Lin et al. ..... 439/342
6,439,913 B1 * 8/2002 Ma ..... 439/342
6,537,096 B2 * 3/2003 Szu et al. ..... 439/342

* cited by examiner

*Primary Examiner*—Lynn Feild
*Assistant Examiner*—Son V. Nguyen
(74) *Attorney, Agent, or Firm*—Wei Te Chung

(57) ABSTRACT

A ZIF socket (1) includes a base (10), a cover (20) slidably mounted on the base, a plurality of conductive terminals (30) received in a plurality of passageways (12) defined in the base, and an actuation protection device (24). The base defines a recess (16) at one end thereof, and the cover defines a through slot (22) at one end thereof corresponding to the recess. The actuation protection device includes a tenon (240) insert-molded in the cover, and a stop (242) protruding upwardly from the tenon. When an actuation tool (5) actuates the cover to slide between a first position and a second position, the actuation tool directly abuts against the actuation protection device. Therefore, the actuation protection device protects the cover and an associated CPU from being damaged by the actuation tool. Accordingly, the ZIF socket is apt to have an extended cycles lifetime.

3 Claims, 6 Drawing Sheets

ZERO INSERTION FORCE SOCKET WITH ACTUATION PROTECTION DEVICE

BACKGROUND OF THE INVENTION

1. Field of the Invention

The present invention relates to an electrical socket for electrically connecting an electrical package such as a pin grid array (PGA) chip with a circuit substrate such as a printed circuit board (PCB), and particularly to a zero insertion force (ZIF) mobile socket with a cover and an actuation protection device.

2. Description of Prior Art

ZIF central processing unit (CPU) sockets are widely used in Personal Computer (PC) systems to electrically connect PGA chips with PCBs. A CPU socket comprises a base adapted to be fixed on a PCB, a cover slidably engaged on the base, and an actuator assembled between the base and the cover. The actuator actuates the cover to slide along the base. The socket thereby moves from a second position to a first position and the PGA chip can be electrically connected to and disconnected from the PCB.

China Pats. Nos. ZL95223360.6 and ZL01221158.3 disclose one kind of actuator used in ZIF CPU sockets. Referring to FIG. 6, an actuator 60 comprises an operation portion placed at one side of a socket 6, and a shaft inserted into a cover and a base of the socket 6. When the actuator 60 is rotated to a vertical position, a CPU 4 is attached on the socket 6 with zero insertion force. When the actuator 60 is rotated to a horizontal position, the CPU 4 is electrically connected with a PCB (not shown). However, rotating of the actuator 60 requires extra space adjacent the PCB in the PC system. Therefore this CPU socket is not satisfactory in view of the trend toward development of miniaturized electrical connectors.

U.S. Pat. Nos. 5,730,615, 6,059,596 and China Pat. No. ZL99226538.X disclose another kind of actuator. Referring to FIGS. 7 and 8, a socket 7 comprises a plastic base 70, and a plastic cover 72 attached to the base 70. The plastic base 70 defines an elongate recess 700. The plastic cover 72 defines a through slot 720 in registration with the recess 700. An actuator 5 (such as a screwdriver) can be inserted into the recess 700 via the slot 720. In operation, the actuator 5 is turned to push the cover 72 to slide along the base 70.

However, when the actuator 5 is rotated, the actuator 5 directly abuts and rubs against the cover 72. In addition, the actuator 5 is prone to directly abut against a CPU 4 assembled on the cover 72. The large force exerted by the actuator 5 can deform and damage the cover 72. Similarly, the CPU 4 is also liable to be damaged by the actuator 5.

A new ZIF socket that overcomes the above-mentioned problems is desired.

SUMMARY OF THE INVENTION

Accordingly, an object of the present invention is to provide a ZIF socket having an actuation protection device which protects a cover of the socket and an associated CPU from damage.

In order to achieve the above object, a ZIF socket in accordance with a preferred embodiment of the present invention comprises a base, a cover slidably mounted on the base, a plurality of conductive terminals, and an actuation protection device. The base defines a recess at one end thereof, and the cover defines a through slot at one end thereof corresponding to the recess. The conductive terminals are received in passageways defined in the base. The actuation protection device comprises a tenon insert-molded in the cover, and a stop protruding upwardly from the tenon. When an actuation tool actuates the cover to slide between a first position and a second position, the actuation tool directly abuts against the actuation protection device. Therefore, the actuation protection device protects the cover and an associated CPU from being damaged by the actuation tool. Accordingly, the ZIF socket is apt to have an extended cycles lifetime.

Other objects, advantages and novel features of the present invention will become more apparent from the following detailed description when taken in conjunction with the accompanying drawings, in which:

DESCRIPTION OF THE PREFERRED EMBODIMENT

Reference will now be made to the drawings to describe the present invention in detail.

Figure 1:
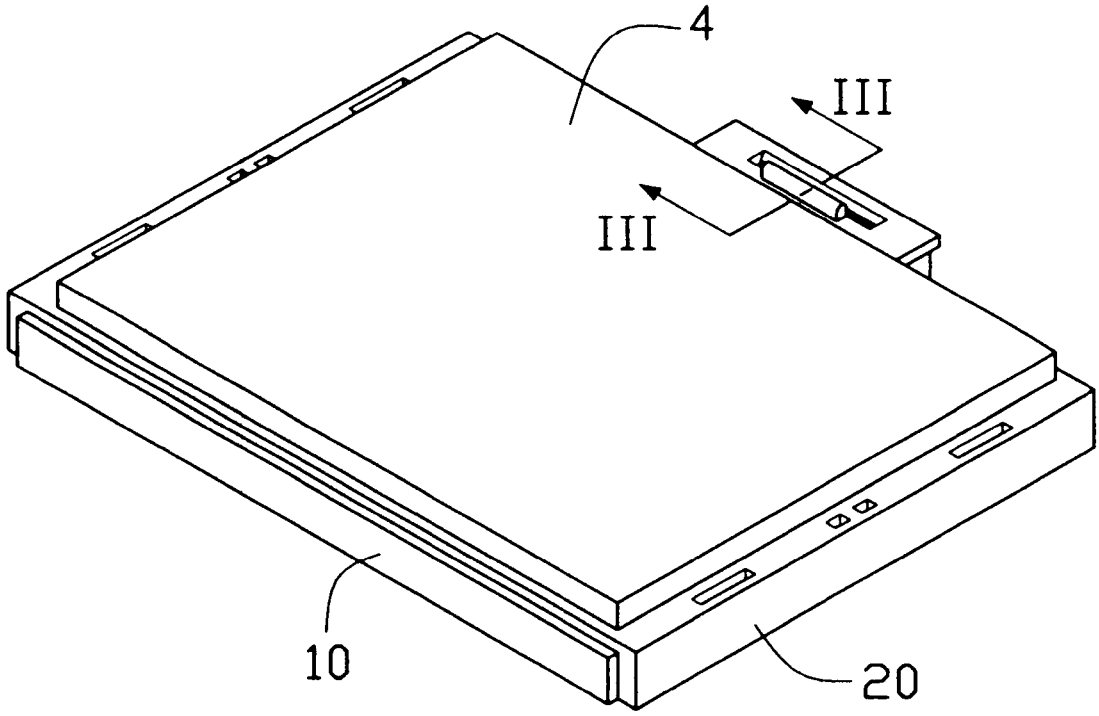
FIG. 1 is an isometric view of a ZIF socket in accordance with a preferred embodiment of the present invention, together with a CPU mounted thereon.
Figure 2:
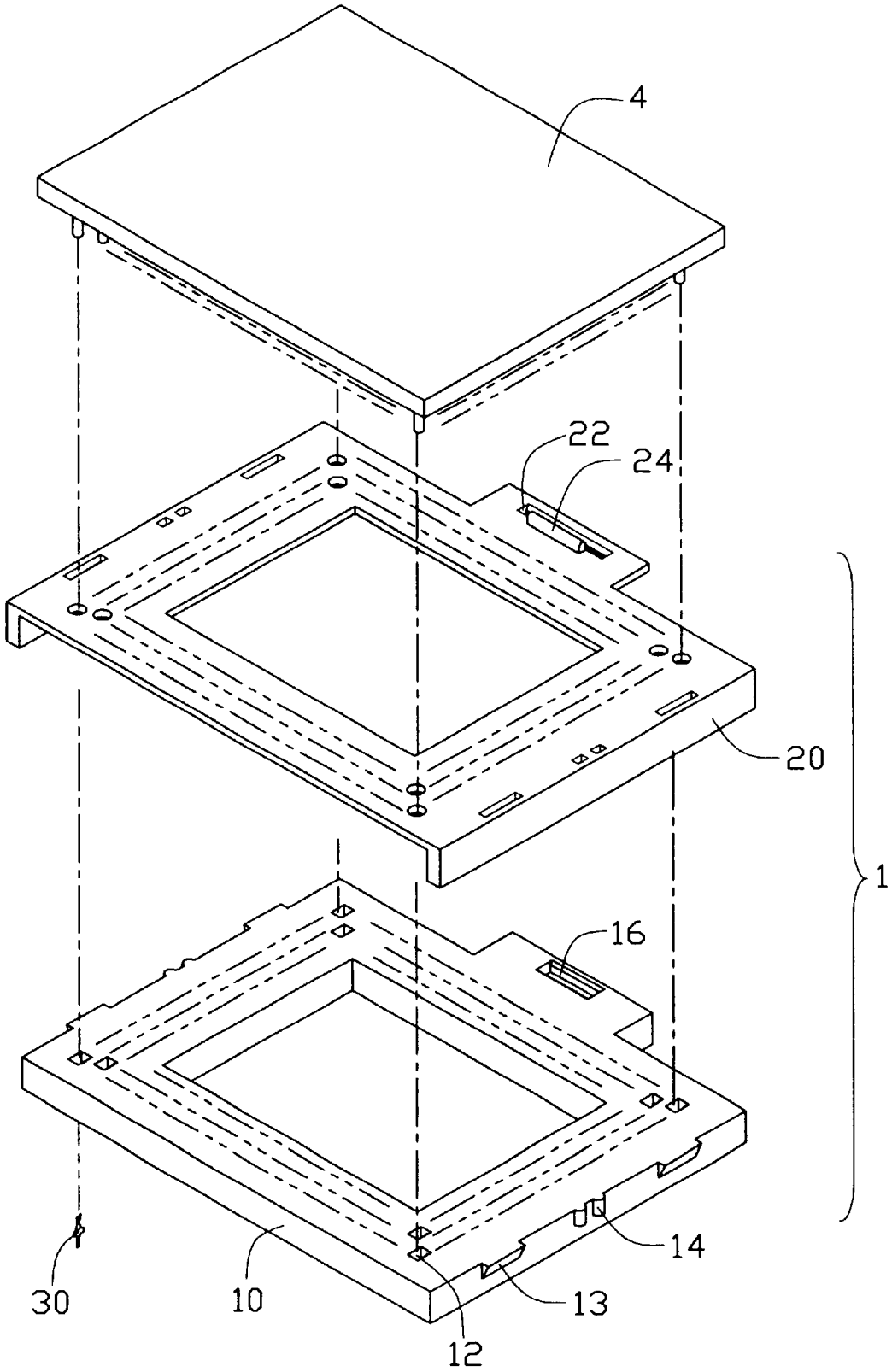
FIG. 2 is an exploded and simplified view of FIG. 1.

Referring to FIGS. 1 and 2, a zero insertion force socket 1 having an actuation protection device in accordance with the present invention comprises an insulative base 10, an insulative cover 20 and a multiplicity of conductive terminals 30.

A multiplicity of passageways 12 is defined in the base 10. The passageways 12 form a rectangular array, and the terminals 30 are respectively received in the passageways 12. The cover 20 is mounted on the base 10, and slides along the base 10 between a first position and a second position. A pair of spaced latch portions 13 is outwardly formed on each of two opposite side faces of the base 10. A pair of positioning blocks 14 is outwardly formed on each of the two opposite side faces of the base 10, between the corresponding latch portions 13. The latch portions 13 and the positioning blocks 14 engage in respective cavities (not shown) of the cover 20. This ensures sturdy and reliable attachment of the cover 20 on the base 10.

Figure 3:
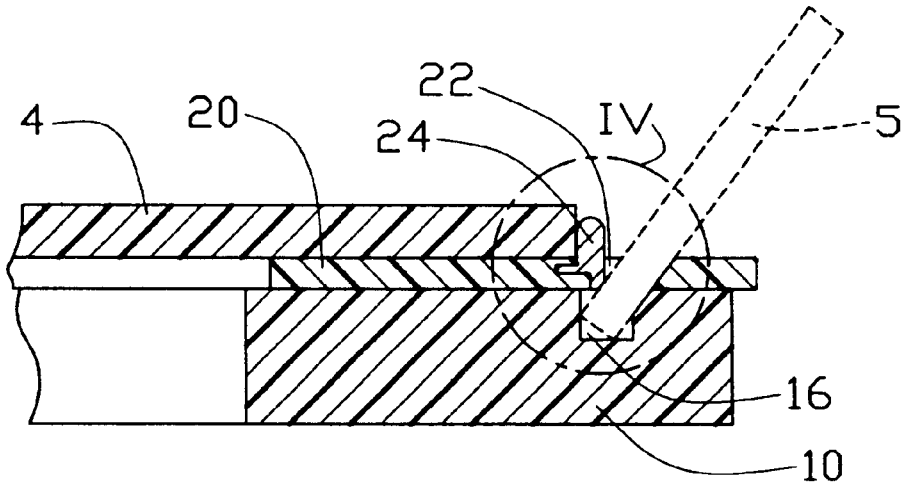
FIG. 3 is a cross-sectional view taken along line III—III of FIG. 1, also schematically showing an actuation tool engaged in the ZIF socket, and further showing a cover of the ZIF socket in a first position.
Figure 4:
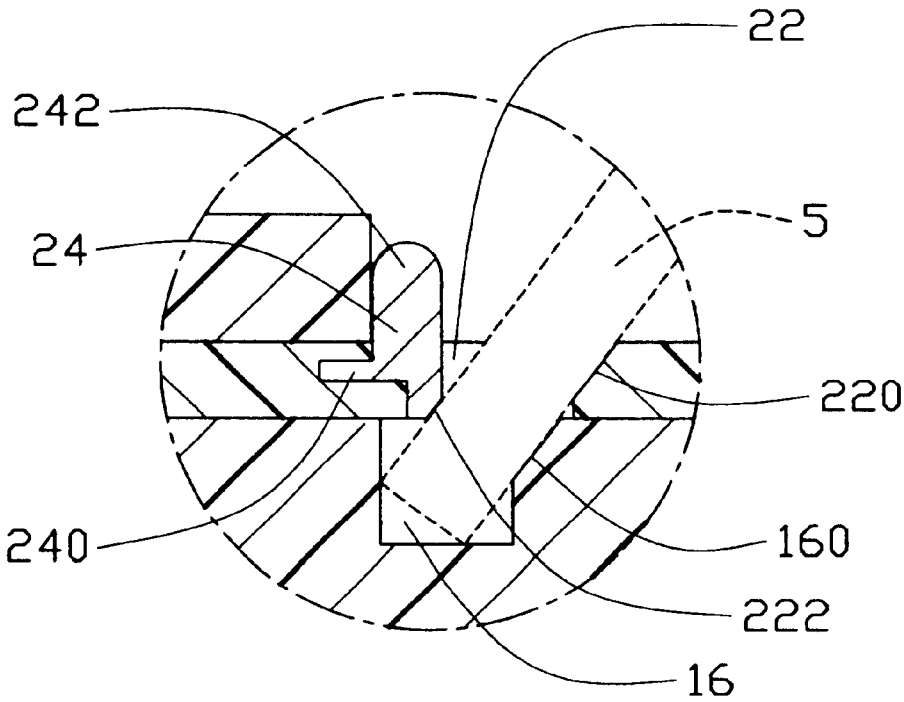
FIG. 4 is an enlarged view of a circled portion IV of FIG. 3.

Referring also to FIGS. 3 and 4, an elongated recess 16 is defined in an expansion section formed at one side of the base 10 that is between said opposite side faces. A first chamfer 160 is formed in the expansion section at a rear of a top portion of the recess 16. The cover 20 defines a through slot 22 in one end thereof, above and in general alignment with the recess 16 of the base 10. A second chamfer 220 is formed in the cover 20 at a rear of a top portion of the slot 22. A third chamfer (not shown) is formed in the cover 20 at a front of a bottom portion of the slot 22. A plane of the second chamfer 220 is parallel to a plane of the third chamfer (not shown).

When the cover 20 is in the first position, the slot 22 is offset slightly rearwardly from the recess 16, yet still parallel to and in communication with the recess 16. The first and second chamfers 160, 220 are in a same plane, and a CPU 4 is mounted on the cover 20 with zero insertion force. When the cover 20 is in the second position, the slot 22 is aligned with the recess 16, and the CPU 4 can be electrically connected with the terminals 30.

A metallic actuation protection device 24 is partially insert-molded in the cover 20 adjacent a front portion of the slot 22. The actuation protection device 24 comprises a tenon 240 insert-molded into the cover 20, and a stop 242 protruding upwardly from the tenon 240. A fourth chamfer 222 is formed in the tenon 240 at a rear of a bottom portion thereof. The fourth chamfer 222 is coplanar with the third chamfer (not shown) of the cover 20. A height of the stop 242 is slightly less than a thickness of the CPU 4, to protect the CPU 4 from being damaged by an actuation tool 5.

Figure 5:
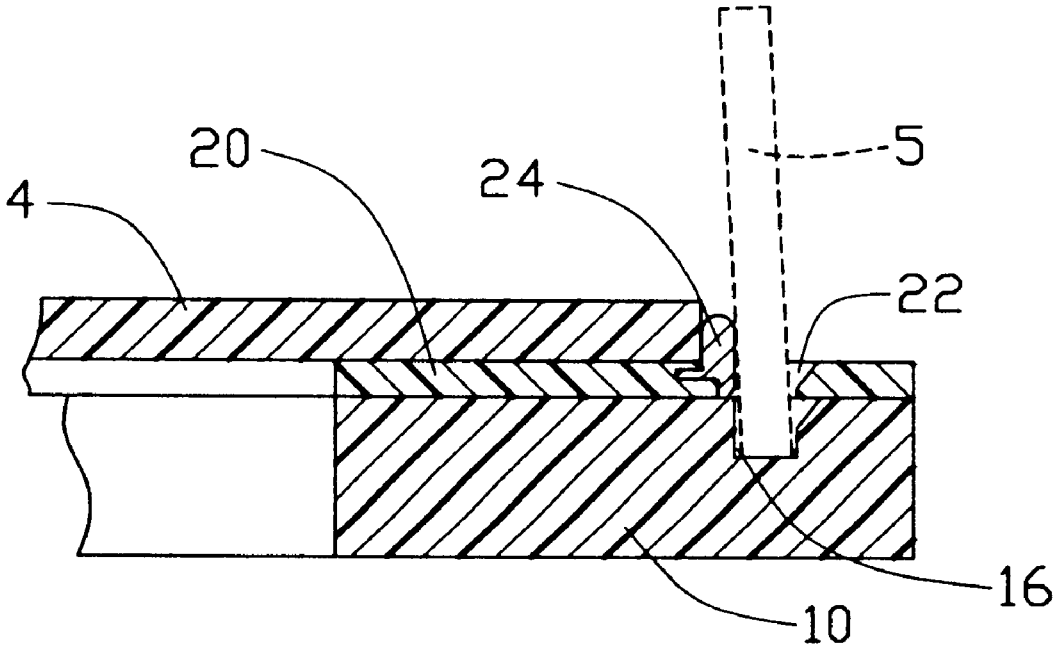
FIG. 5 is similar to of FIG. 3, but showing the cover in a second position.
Figure 6:
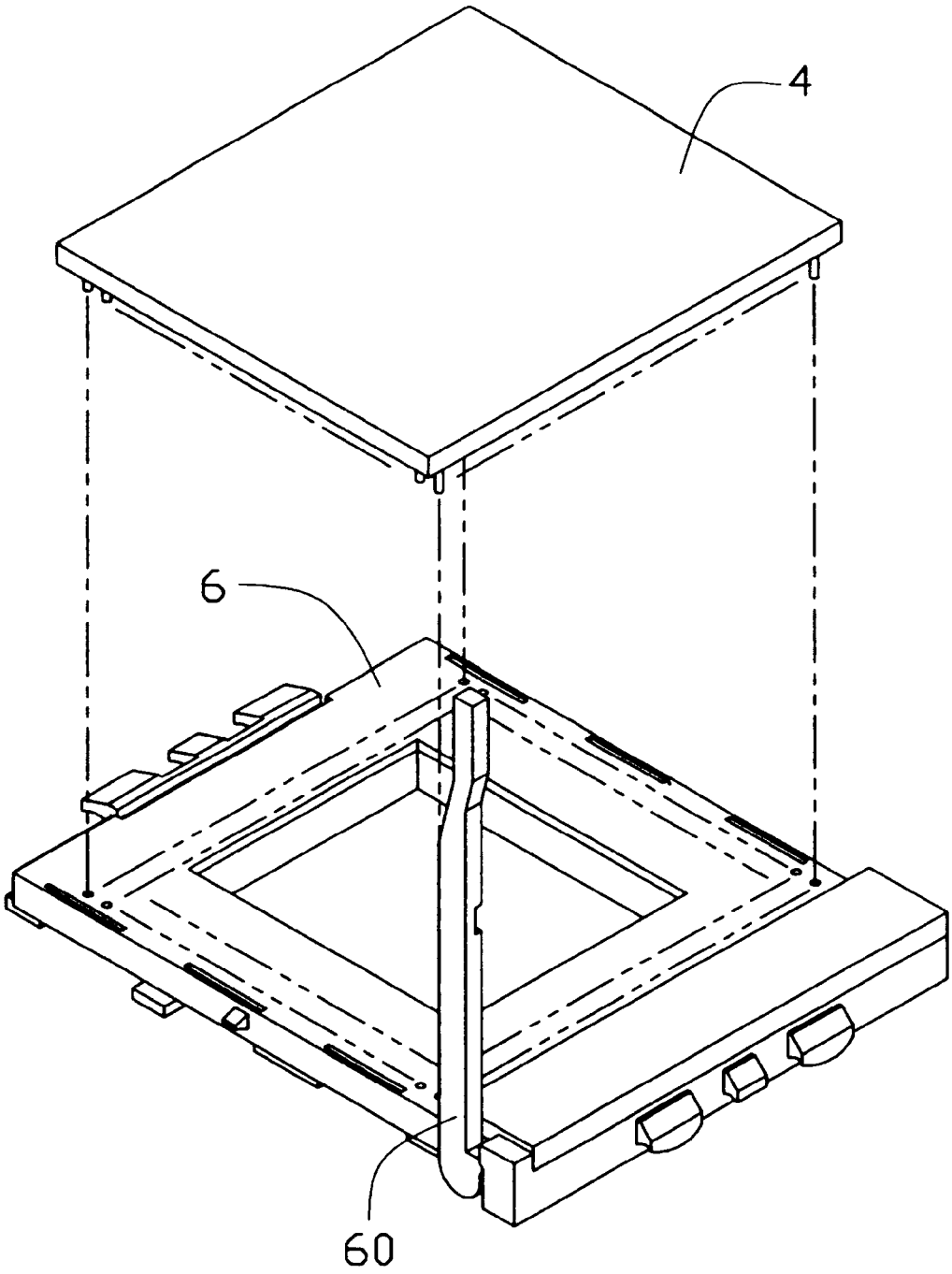
FIG. 6 (PRIOR ART)
FIG. 6 is an exploded, isometric view of a first conventional ZIF socket and a CPU.
Figure 7:
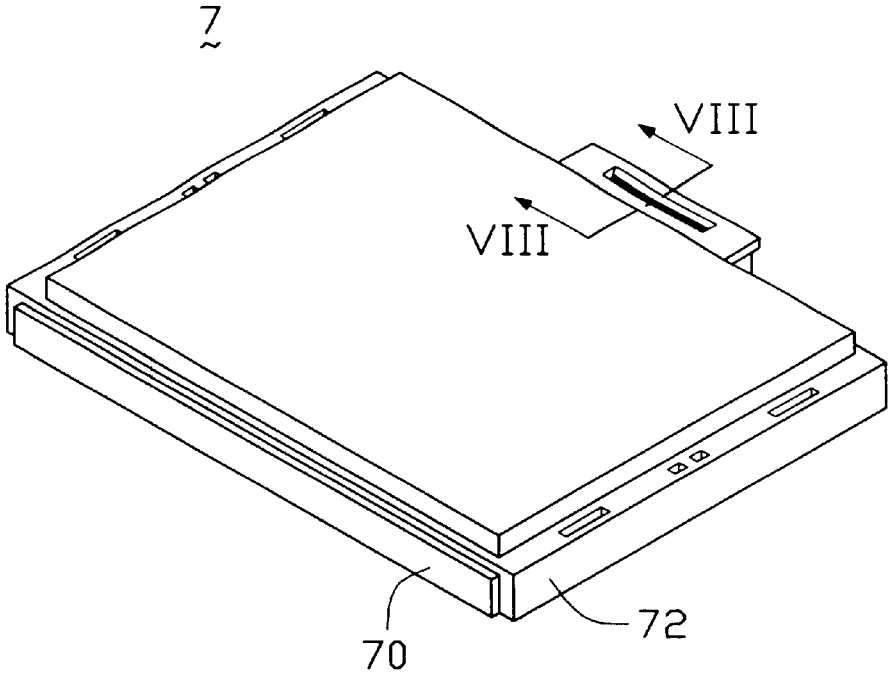
FIG. 7 (PRIOR ART)
FIG. 7 is an isometric view of a second conventional ZIF socket with a CPU mounted thereon.
Figure 8:
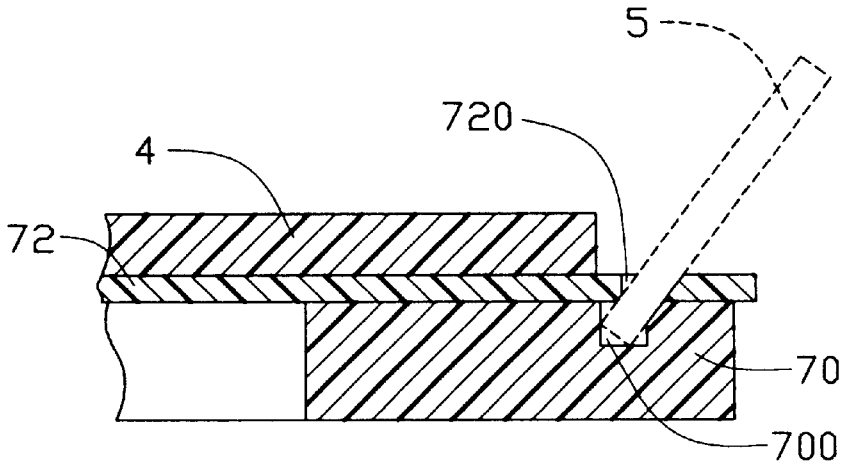
FIG. 8 (PRIOR ART)
FIG. 8 is a cross-sectional view taken along line VIII—VIII of FIG. 7.

Referring particularly to FIGS. 3 and 5, when the cover 20 is in the first position, the actuation tool 5 is inserted into the slot 22 and the recess 16 at an acute angle. The actuation tool 5 may, for example, be a screwdriver. The actuation tool 5 rests on the first chamfer 160 of the expansion section and the second chamfer 220 of the cover 20, while bearing against the fourth chamfer 222 of the actuation protection device 24. The actuation tool 5 is then rotated to a vertical position, and the cover 20 is pushed to the second position. The actuation tool 5 thereby actuates the cover 20 to slide along the base 10 between the first position and the second position. Because the actuation tool 5 directly abuts against the actuation protection device 24, a main body of the cover 20 and the CPU 4 are both protected from being damaged by the actuation tool 5. Accordingly, the zero insertion force socket 1 is apt to have an extended cycles lifetime.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. A zero insertion force socket for electrically connecting an electrical package with a circuit substrate, the zero insertion force socket comprising:

a base defining a plurality of passageways therethrough, for receiving a plurality of conductive terminals therein;

an insulative cover slidably mounted on the base, supporting the electrical package; and an actuation protection device provided on the cover, the actuation protection device comprising an L-shaped tenon and a stop;

wherein an actuation tool can abut against the actuation protection device and actuate the cover to slide between a first position and a second position, whereby the actuation protection device protects the cover and the electrical package from damage; wherein the actuation protection device is made of metal; wherein the tenon is insert-molded in the cover, and the stop upwardly protrudes from the tenon; wherein a recess is defined in an expansion section formed at one side of the base; wherein the cover defines a slot in one end thereof; wherein a chamfer is formed at a rear of a bottom portion of the tenon, facilitating the actuation tool inserting into the slot of the cover and the recess of the base.

2. The zero insertion force socket as described in claim 1, wherein the expansion section of the base forms at least one chamfer at the recess.

3. The zero insertion force socket as described in claim 1, wherein the cover forms at least one chamfer at the slot.

* * * * *